US006840378B2

(12) United States Patent
Toguchi

(10) Patent No.: US 6,840,378 B2
(45) Date of Patent: Jan. 11, 2005

(54) CONNECTION STRUCTURE OF STORAGE COMPARTMENT

(76) Inventor: Yoshiaki Toguchi, 3-18-8 Makiminato, Urasoe-shi, Okinawa (JP)

( * ) Notice: Subject to any disclaimer, the term of this patent is extended or adjusted under 35 U.S.C. 154(b) by 143 days.

(21) Appl. No.: 10/077,811

(22) Filed: Feb. 20, 2002

(65) Prior Publication Data

US 2002/0134700 A1 Sep. 26, 2002

(30) Foreign Application Priority Data

Mar. 23, 2001 (JP) ..... 2001-085461

(51) Int. Cl.[7] ..... B65D 21/02
(52) U.S. Cl. ..... 206/503; 206/510; 220/4.27
(58) Field of Search ..... 206/503, 510, 206/506, 509; 220/4.26, 4.27, 23.86, 23.4, 1.5; 414/347; 294/81.54

(56) References Cited

U.S. PATENT DOCUMENTS 2,053,969 A * 9/1936 Olds ..... 220/1.5
3,014,604 A * 12/1961 Loomis ..... 414/347
3,061,134 A * 10/1962 Fesmire et al. ..... 220/1.5
3,162,320 A * 12/1964 Hitch et al. ..... 220/23.4
3,734,308 A * 5/1973 Pasternack ..... 420/63
4,109,789 A * 8/1978 Fattori et al. ..... 206/404
4,616,752 A * 10/1986 Ridgley ..... 206/533
6,024,223 A * 2/2000 Ritter ..... 206/600

FOREIGN PATENT DOCUMENTS

JP 06-199091 * 7/1994
JP 2002-284169 * 10/2002

* cited by examiner

*Primary Examiner*—Joseph C. Merek
(74) *Attorney, Agent, or Firm*—Ronald E. Greigg

(57) ABSTRACT

A connection structure of a storage compartment consists of handles stored into a storage part provided at a top board member of the storage compartment; engaging pieces arranged at a base board and engages with means for engaged in the storage compartment located below due to a spring power of a spring in case that the handles are laid flat at a vertical state respectively; means for traction to connect to the handles and engaging piece respectively; and the engaging piece, in case that the storage compartments having same form are piled up respectively, interlocks a movement of the handles in a case that the handle installed with the storage compartment located above is brought at a standing-up state and rotates in a moving direction against the spring power of the spring, so that it can connect or dissociate automatically by only operating the handle prepared in the top board member.

8 Claims, 16 Drawing Sheets

CONNECTION STRUCTURE OF STORAGE COMPARTMENT

BACKGROUND OF THE INVENTION

The present invention relates to a connection structure of a storage compartment. More specifically, this invention relates to the connection structure of the storage compartment that suits when the storage compartment of the same form or the same structure is constructed and piled up in a vertical direction respectively.

When the portable storage compartment is piled up in the vertical direction, to join together integrally in consideration of earthquake resistance is demanded.

Also it is demanded to adjust to increase in the data which should be saved for a long time, separates easily the storage compartment having the same form other storage compartment and carries to the desired place and arranges in case that nation, prefectures, research institute and offices arrange the documents such as important materials, official document and incident documents into the storage compartment.

This inventor (applicant) proposed the document arrangement box aiming at the efficient document management by the flow of a document to Japan, the U.S., etc. (Japanese Patent Publication No. 7-100397). However, it was not fully only able to satisfy the above requests that the document arrangement box proposed previously only accumulated the boxes of the same form or the same structure.

SUMMARY OF THE INVENTION

Accordingly, it is an object of the present invention to provide a connection structure of a storage comportment which can connect or dissociate automatically (remote) by only operating the handle prepared in top board member, when accumulating the storage compartment of the same form piled up longitudinally. It is another object of the present invention to provide a connection structure of a storage comportment which can be carried the storage compartment located upward to a desired place only by carrying out one-touch control of making a handle stand up. It is still another object of the present invention to provide a connection structure of a storage comportment that the number of parts can be reduced. It is still more specific object of the present invention to provide a connection structure of storage comportment which Assembly parts can be reduced. It is a further object of the present invention to provide a connection structure of a storage comportment that can avoid attaching a crack to the top board member of a storage compartment located below, in case that other storage compartments with the same form are put upon a lower storage compartment.

The novel features which are believed to be characteristic of the invention, both as to its organization and method of operation, together with further objects and advantages thereof, are described below with reference to the accompanying drawings in which a presently preferred embodiment of the invention is illustrated as an example.

It is to be expressly understood, however, that the drawings are for the purpose of illustration and description only, and are not intended as a definition of the limits of the invention.

BRIEF DESCRIPTION OF THE DRAWINGS

FIG. 1 is a perspective view showing a first embodiment of the present invention;

FIG. 2 is an exploded perspective view of a storage compartment;

FIG. 3 is a schematic vertical sectional view from the front of a storage compartment and showing the way which a handle lays down;

FIG. 4 is a schematic vertical sectional view from the side of a storage compartment and showing the way which a handle lays down;

FIG. 5 is an explanation view showing a relationship between a handle and top board member;

FIG. 6 is a perspective view showing the way in which a handle is attached to a top board member;

FIG. 7 is a schematic sectional view of a main member (including a top board member and handle);

FIG. 8 is a schematic explanation view (partial cutaway in a support frame) from the side of a main member (engaging piece);

FIG. 9 is a schematic explanation view from the side of a main member (engaging piece);

FIG. 10 is a schematic vertical sectional view from the front of a storage compartment and showing the way which a handle stands up;

FIG. 11 is a schematic vertical sectional view from the side of a storage compartment and showing the way which a handle stands up;

FIG. 12 is a schematic explanation view showing the way in which storage compartments having same structure piles up respectively;

FIG. 13 is an explanation view showing an engaging state of an engaging piece in a lower storage compartment when a handle in an upper storage compartment is laid flat;

FIG. 14 is a schematic sectional view from the front according to FIG. 13;

FIG. 15 is a schematic explanation view of a main part showing a second embodiment of the present invention;

FIG. 16 is an explanation showing the way in which an engaging piece rotates in an unlocking direction in association with standing up a handle and an engaging piece is fitted with a locking piece when storage compartments are piled up respectively; and FIG. 17 is an explanation view showing the way which storage compartments pile up respectively and a handle is laid flat.

DETAILED DESCRIPTION

Preferred embodiments of the present invention are described in more detail below referring to the accompanying drawings. An understanding of the present invention may be best gained by reference FIGS. 1 to 12. FIGS. 1 to 12 illustrate a storage compartment device of a first embodiment of the present invention.

(1) Schematic Explanation of Embodiment of the Present Invention

Figure 1:
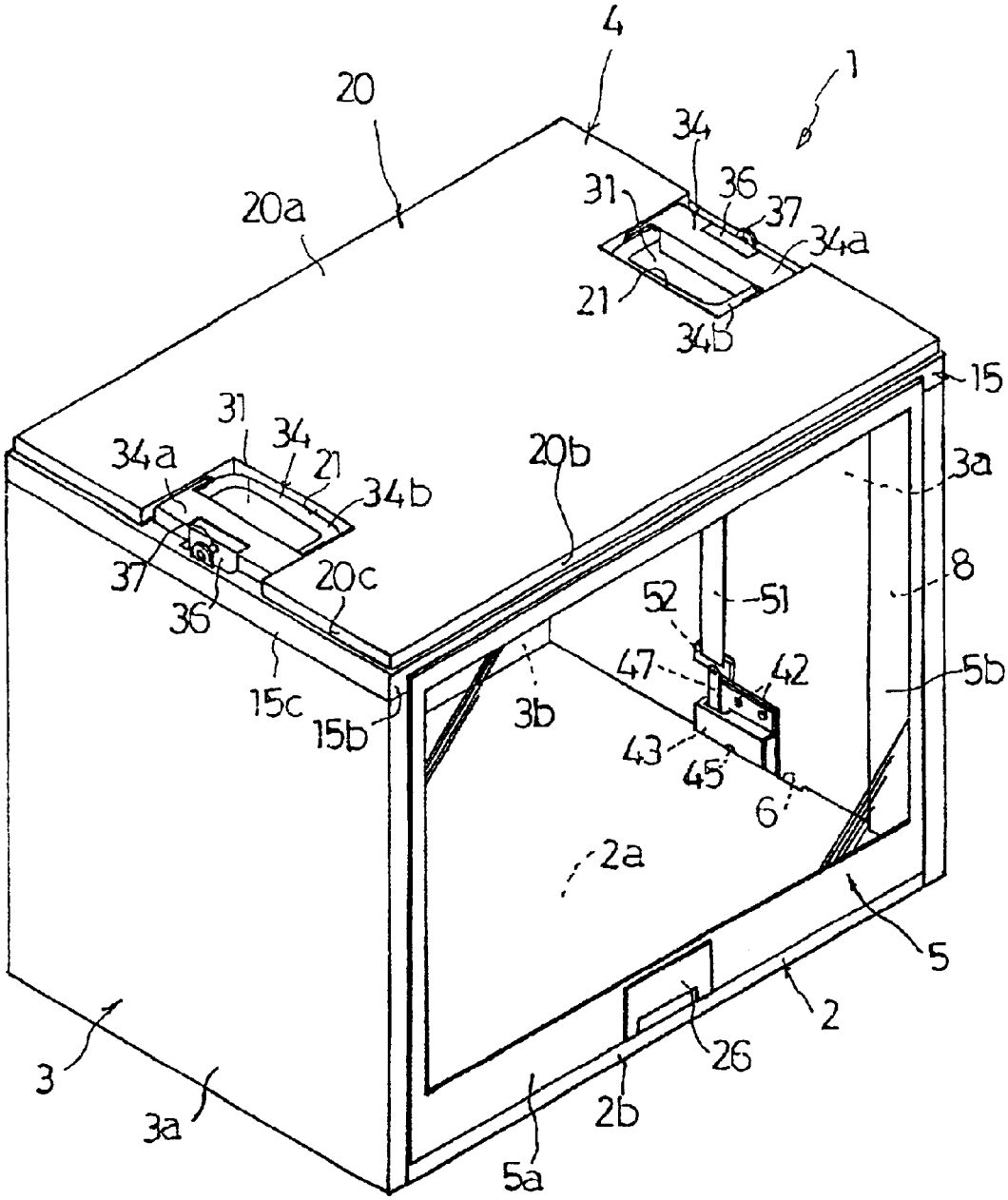
FIGS. 1 to 14 illustrate an explanation view showing a first embodiment of the present invention respectively.
Figure 2:
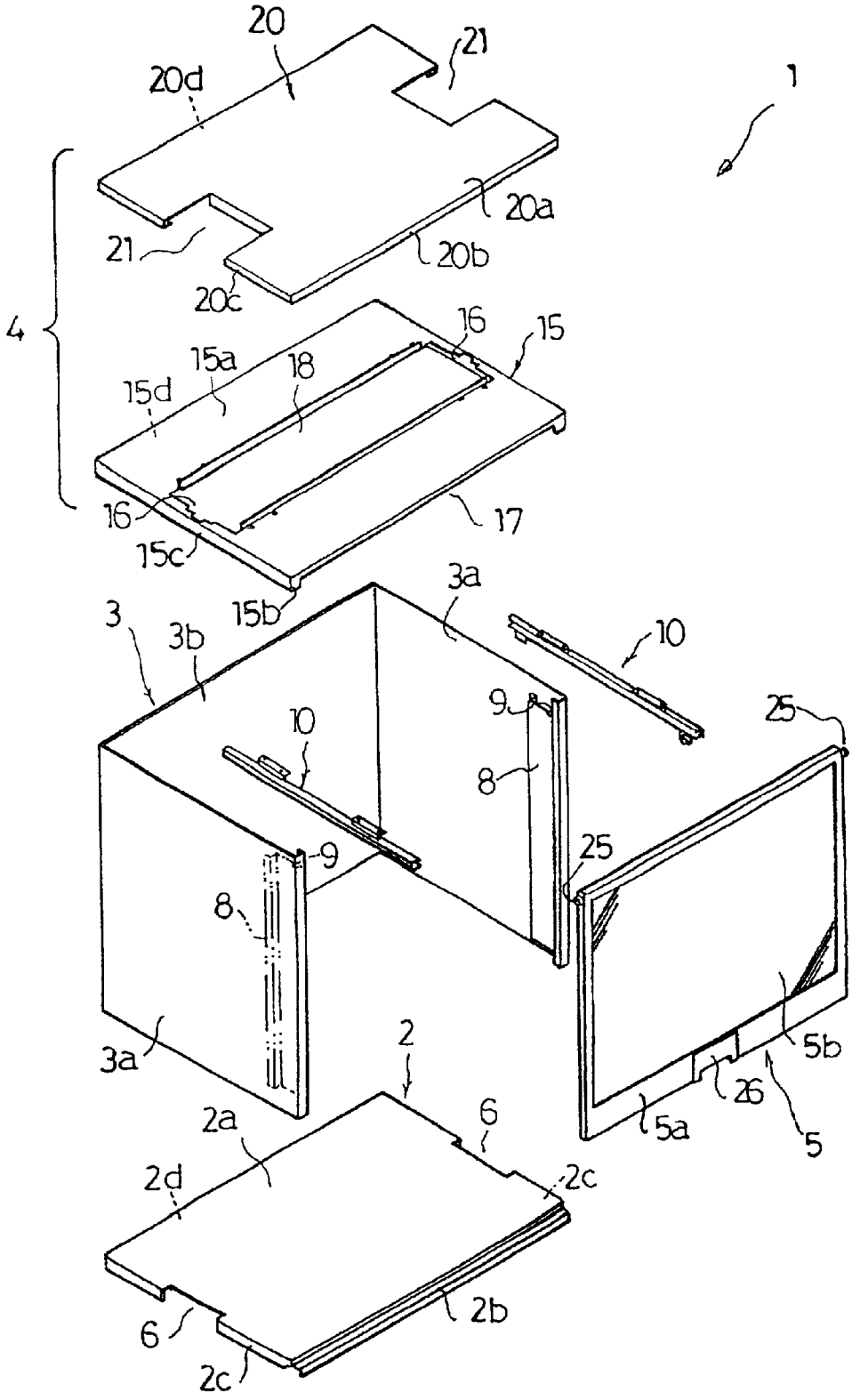

First, the whole (a storage compartment 1) of embodiment of the invention by references shown in FIGS. 1 and 2 is explained. The numeral 1 shows a storage compartment made from steel. This storage compartment 1 is used in order to mainly contain the document for preservation and consists of a base board 2, a side board 3 of the shape of an end surface and fixed to the base board integrally, a top board member 4 fixed to the side board 3 integrally and a door 5 provided slidely to the top board member 4 or the side board 3. The storage compartment 1 can be carried through a pair of handles provided at right side and left sides thereof.

(2) Base Board

The base board 2 consists of a base part 2*a* formed in the shape of a rectangle and short side wall portions 2*b*, 2*c* and 2*d* which provided continuously in a lower direction at sides of the base part 2*a* respectively. The sidewall portion 2*b* equivalent to a front wall is formed in the shape of a step so that the lower end of the door 5 can be supported. Moreover, small notch portions 6 and 6 are formed in a central part of right and left sides of the sidewall portions 2*c* and 2*c* equivalent to a sidewall and base part 2*a*.

(3) Side Board

The numeral 3*a*, 3*a* show sidewalls respectively, and the edges of a tip part of the sidewalls 3*a* are bent inside respectively. The numeral 3*b* shows a back wall which provided continuously at the sidewalls 3*a*. The support member for the door 5 is attached to the sidewall in this embodiment. The numeral 8 shows a pair of support boards having a small fitting groove 9 at the upper end portion thereof. The support boards 8 are fixed to an inner wall surface at the tip portion of the sidewalls 3*a* respectively. The numeral 10 shows a pair of guide rails which guide to the door 5, and the guide rails 10 are fixed to an inner board 15 of the top board member through means for fixing which is not illustrated respectively.

(4) Top Board Member

As illustrated in FIG. 2, the top board member 4 includes a large board and a small board, combining them integrally. That is, the numeral 15 shows the inner board including a larger one, and the inner board 15 consists of top portion 15*a* and the short side wall portions 15*b*, 15*c* and 15*d* which provided continuously in a lower direction at sides of the top portion 15*a*. An opening or notch 16 for traction means is formed at both sides in the central parts of the top portion 15*a* at least. Moreover, an opening portion 17 for receiving the door equivalent to the width size of the door 5 is provided at the sidewall portion 15*b* as a front wall. In addition, the hole for screws is formed at the inner board 15.

On the other hand, the numeral 20 shows the outer board with small size, and the outer board 20 consists of a top wall portion 20*a* and the short sidewall portions 20*b*, 20*c* and 20*d* which provided continuously in a lower direction at sides of the top wall portion 20*a*. Concave portions 21, 21 for receiving the handle (storage portion) are symmetrically formed at both sides in the central part of the top wall portion 20*a* respectively. The concave portion 21 is formed in the shape of a rectangle corresponding to the form of the handle mentioned later. By the way, a big opening portion 18 is formed in the center of the inner board 15, and the central opening portion 18 is passing through the opening 16 (notch in this embodiment) for the traction means mentioned above.

(5) Door

The door 5 consists of a door frame 5*a*, a glass 5*b* attached to the door frame 5*a*, a pair of sliding axles 25 and 25 projected by right and left portions of the upper end of the door frame 5*a* respectively and means for stopping 26 the doors installed with the central part of the lower end of the door frame 5*a*. The sliding axle 25 is engaged with the engaging groove 9 of the support board 8 when the door closes. The sliding axle slides into the guide rail for example if the door 5 is placed at a level state and stuffs it into a back wall 3*b* side when the door 5 is opened.

(6) Connection Structure of the Storage Compartment

Next, the connection structure (mechanism) of the storage compartment having the same form is explained. The connection structure in this invention consists of a handle 34 provided at the top board member of the storage compartment; an engaging piece 41 arranged at the base board of the storage compartment 1 and engaged with an engaging stick provided at the storage compartment placed at a lower position when the handle in the storage compartment placed at a upper position is operated; and means for traction 51 connecting the engaging piece 41 and handle 34. It works when the storage compartments 1 and 1 having the same form are piled up in the vertical direction respectively.

Figure 3:
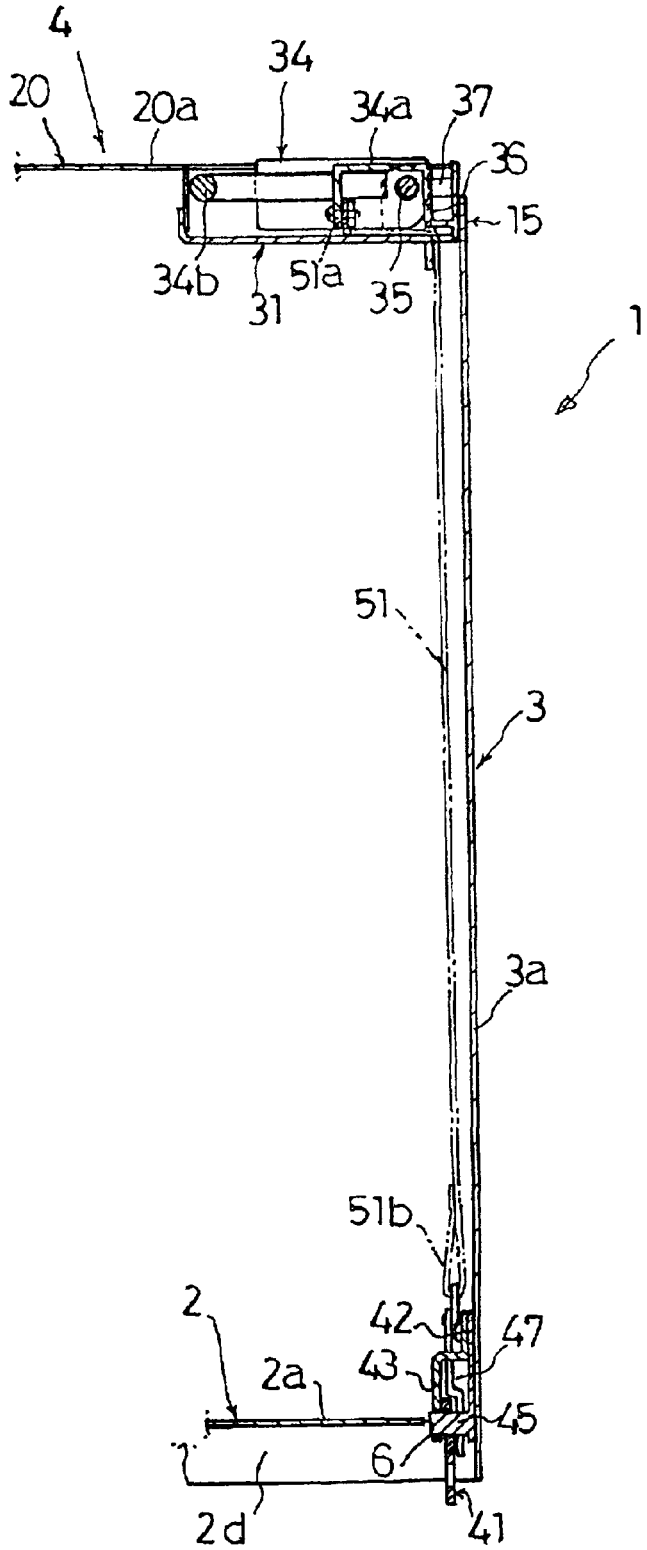
Figure 4:
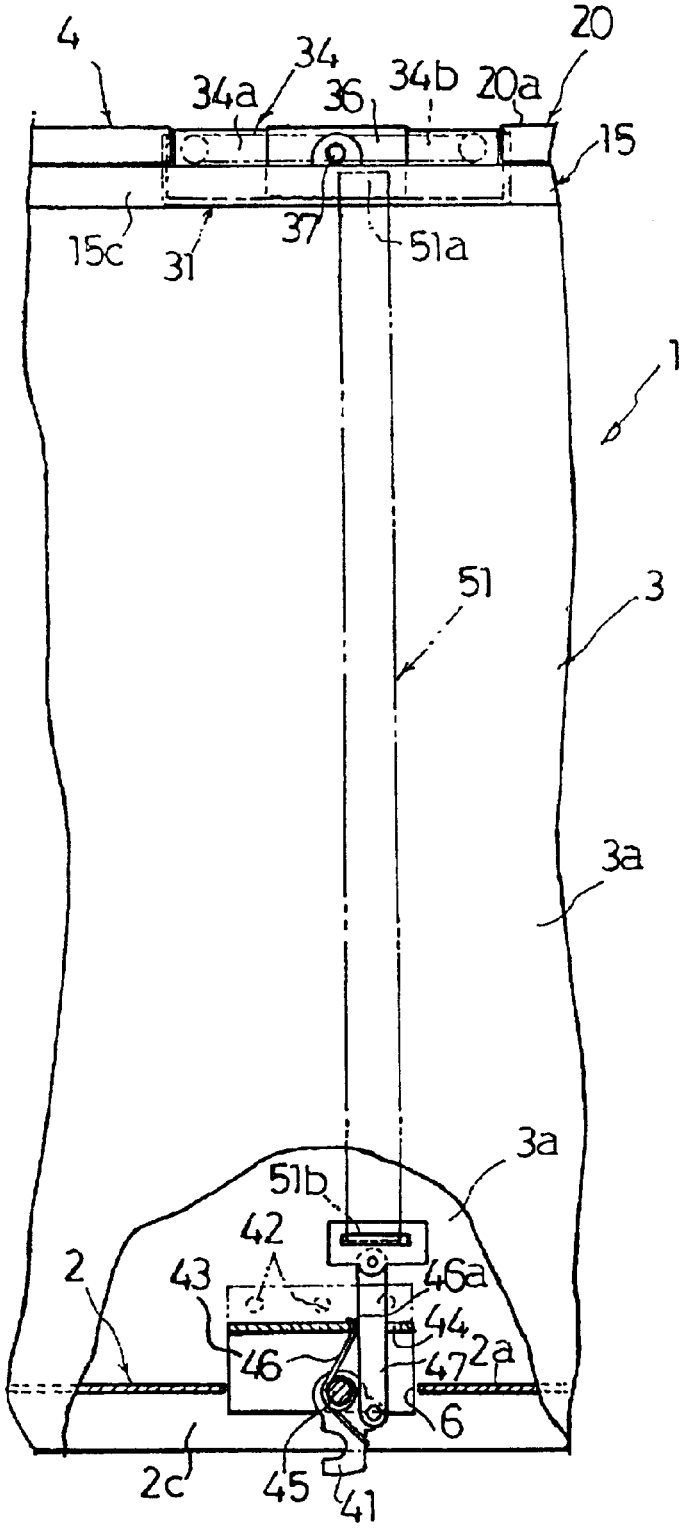
Figure 5:
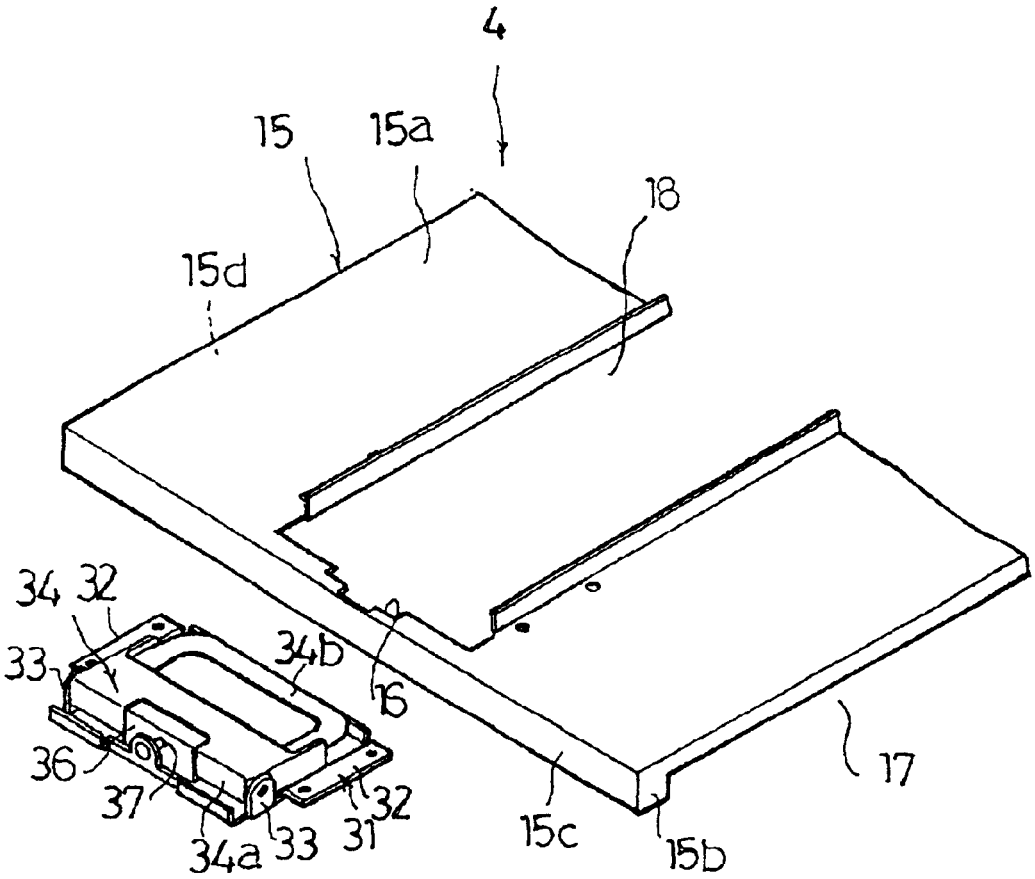
Figure 6:
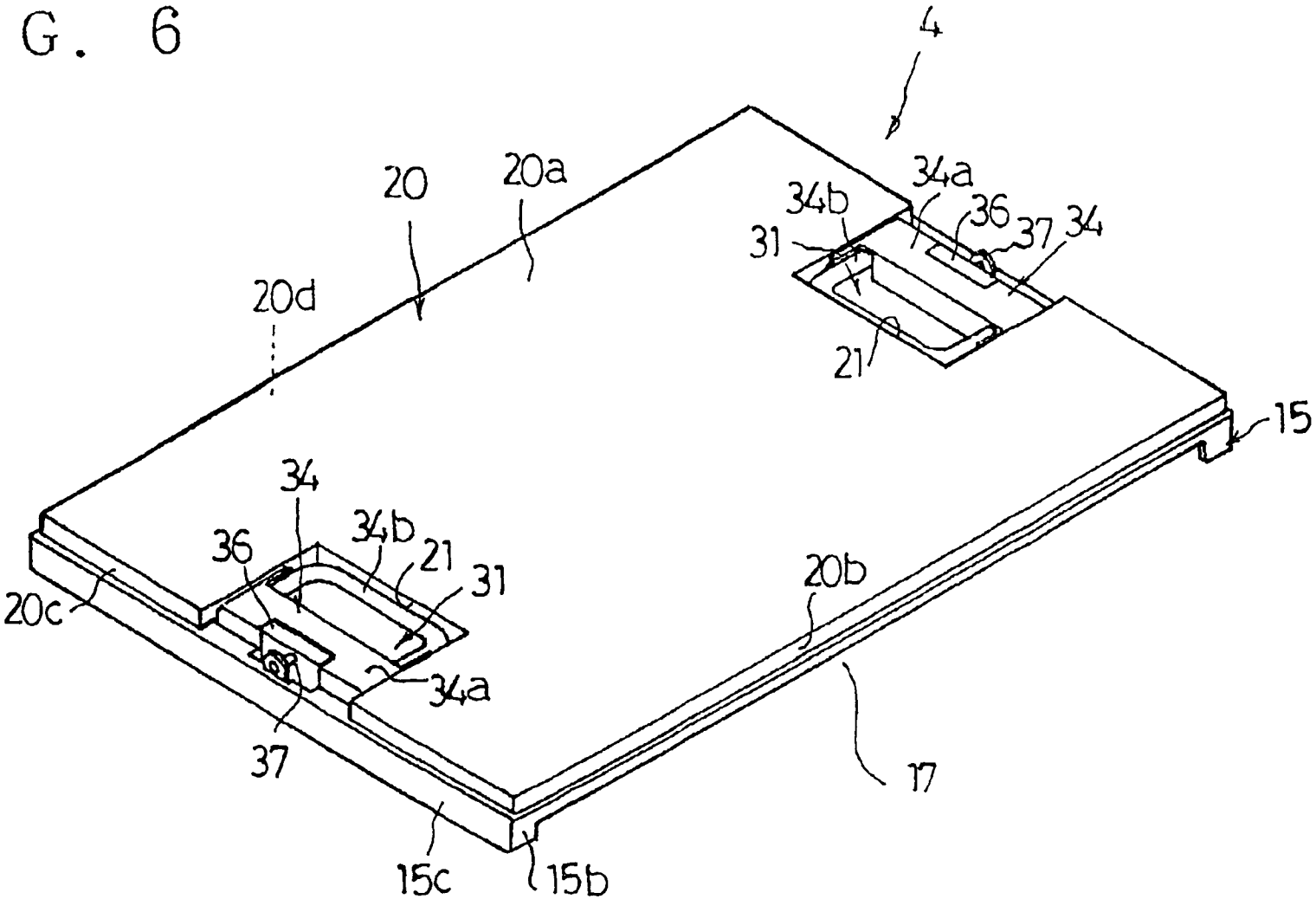
Figure 7:
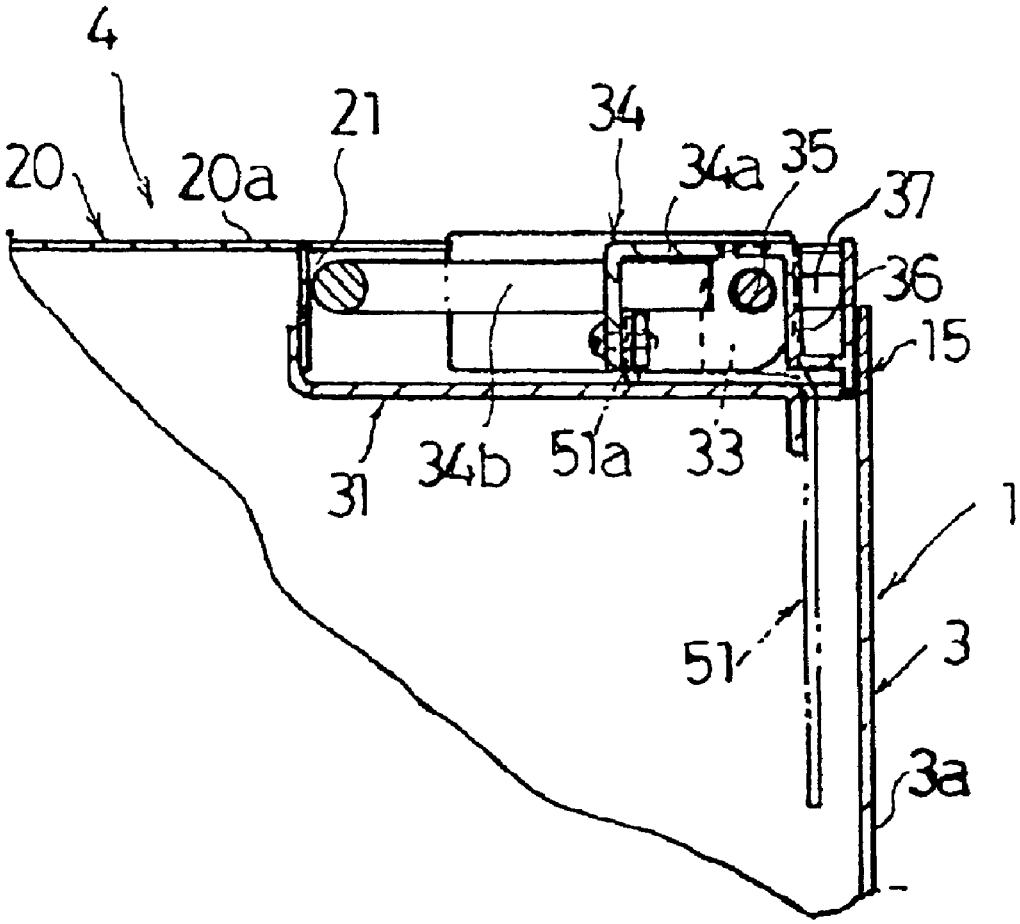

FIGS. 3 and 4 illustrate the explanation view before piling up the storage compartment 1 respectively. Moreover, FIGS. 5 to 7 illustrate each explanation view of the handle. First, the handle is explained by reference in FIGS. 3 to 7. The numeral 31 shows an attachment base board fixed to the right and left ends of the top board member 4 respectively. The attachment baseboard 31 includes a pair of flange parts 32, 32 joined to the inner surface of a wall of the inner board 15 and includes a pair of axle hole parts 33, 33 provided at the part adjacent outer end thereof. The handle 34 is attached rotatably at about 90 degree to the attachment baseboard through the horizontal axis 35 rotatably supported by the axle hole parts 33. In addition, the handle 34 in this embodiment consists of a cover 34*a* at U-shape in a plane view and a grip 34*b* fixed to the cover 34*a*.

Moreover, the engaging stick is fixed to the outer end of the attachment baseboard 31 through a support board 36 formed in the desired shape (Z-shape, for example). Thus, the attachment baseboard 31 assembled integrally the handle 34 and engaging stick 37 is installed with the top board member 4 so as to fit into the opening portion 18 of the inner board 15 upwardly and is fitted by an attachment not shown.

Figure 8:
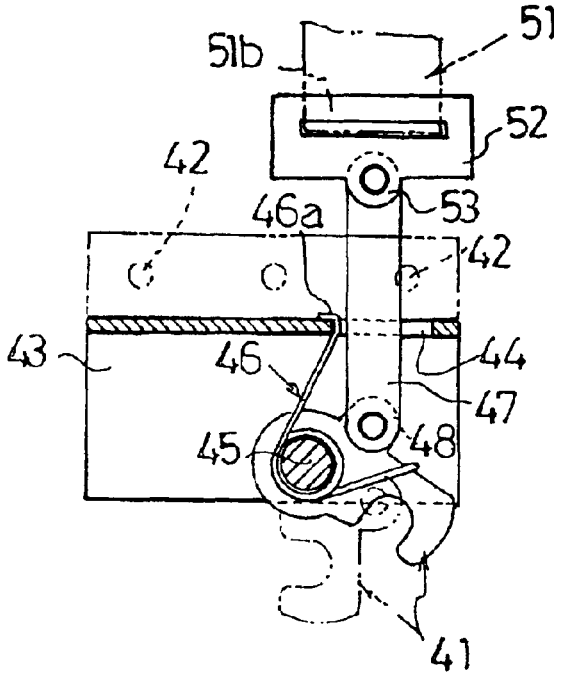
Figure 9:
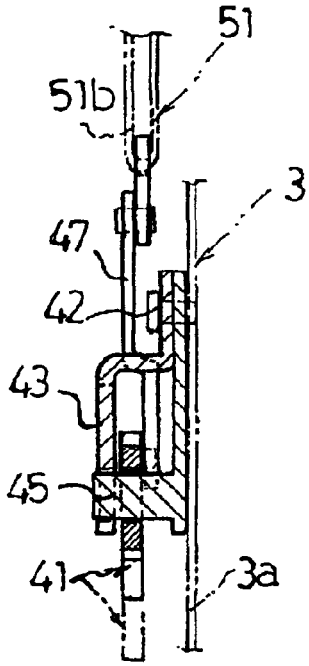

FIGS. 8 and 9 illustrate the engaging piece 41 which engaged with the engaging stick 37 in the storage compartment located below respectively when the storage compartments 1 are piled up respectively. In this embodiment, the engaging piece 41 is supported pivotably by the support frame member 43 fixed to inner wall surface of the sidewalls 3*a* of the sideboard 3 through a plurality of fixture 42 respectively. Moreover, the engaging piece 41 is located into the notch portion 6 so as to projects from the base part 2*a* of the baseboard 2 downward.

Although especially the form of the frame portion 43 is not required, it has the opening 44 for a connection link. The numeral 45 shows an axle supported rotatably between the support frame members 43, and then the axle 45 supports pivotably the engaging piece 41 formed in the shape of a hook.

The numeral 46 shows a spring (torsion coil spring) mounted by winding around the axle 45, and the spring 46 is biased so that the engaging piece 41 may be engaged with the engaging stick 37 of the storage compartment always located below. In addition, an end part 46*a* of the spring 46 is engaged at the edge of the opening 44. Moreover, the engaging piece 41 includes a projection 48 that supports the lower end of the connection link 47.

Next, the traction means 51 to connect the engaging piece 41 and handle 34 is explained. In this embodiment, the traction means uses a belt made from a synthetic resin as an example has flexibility or pliability. Therefore, a string, rope made from synthetic resin, wire, etc. can be used preferably other than a flexible belt.

An upper end 51*a* of the traction means 51 is attached in the end of grip 34*b* of the handle 34 fixedly. On the other hand, other end 51*b* thereof is attached to a connector formed in the shape of a buckle. The part adjacent the upper end 51*a* of the traction means 51 passes through the opening 16 of the inner board 15 and opening portion of the attachment baseboard 31, and it extends along the sidewall 3*a* at a perpendicular state. In addition, the connector 52 includes the projection 53 which supports pivotably at the upper end of the connection link 47 as the engaging piece.

In the above-mentioned composition, the action of the connection structure (mechanism) of the storage compartment is explained. FIGS. 3 and 4 illustrate each explanation view showing the way in which the engaging piece rotates in a engaging direction by the spring power of the spring 46 and is positioned to engage with the engaging stick 37 in the storage compartment 1 located below when the handle 34 is embedded into the concave portion 21 of the top board member 4. In this case, the engaging piece 41 rotates in an engaging direction corresponding to the amount of rotations of the handle 34. Moreover, the belt as the traction means is pulled by the engaging piece which rotates according to the spring power of the spring 46.

Figure 10:
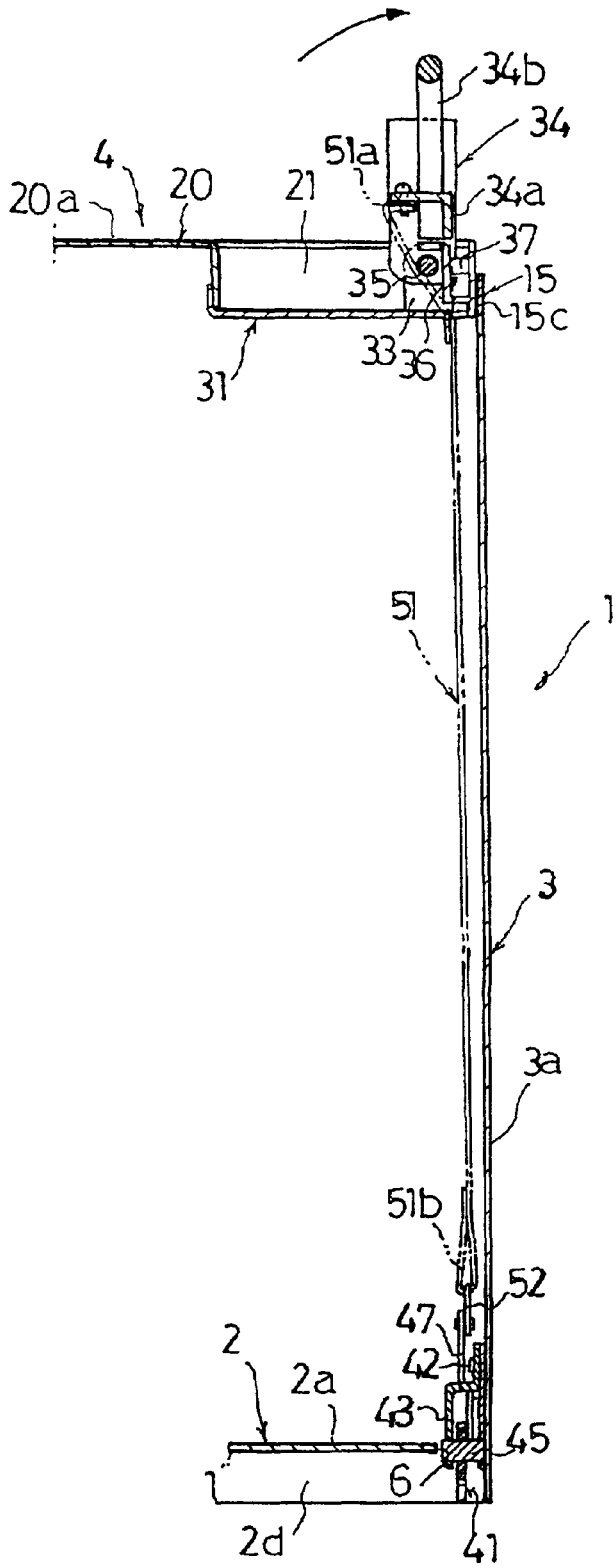
Figure 11:
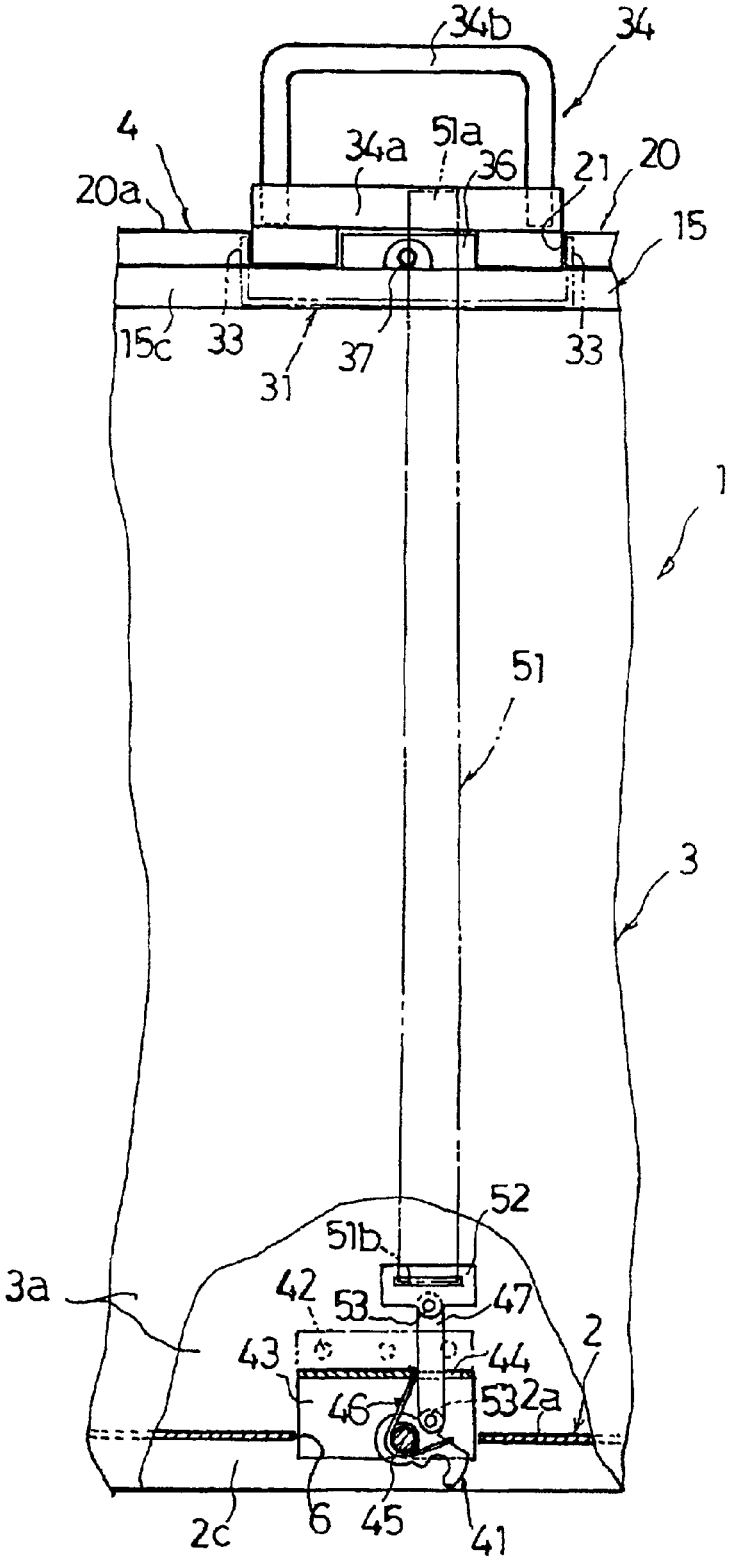

On the other hand, FIGS. 10 and 11 illustrate each explanation view showing the way in which the engaging piece 41 rotates in a cancellation direction against the spring power of the spring 46 as a result, the engaging state with the engaging piece and engaging stick 37 is cancelled when the handle 34 is raised up from the concave portion 21 of the top board member 4. In this case, since the engaging piece 41 is interlocked with the handle 34 and the engaging piece 41 rotates in the cancellation direction against the spring power of the spring 46, the belt as the traction means 51 is pulled by the handle 34.

Figure 12:
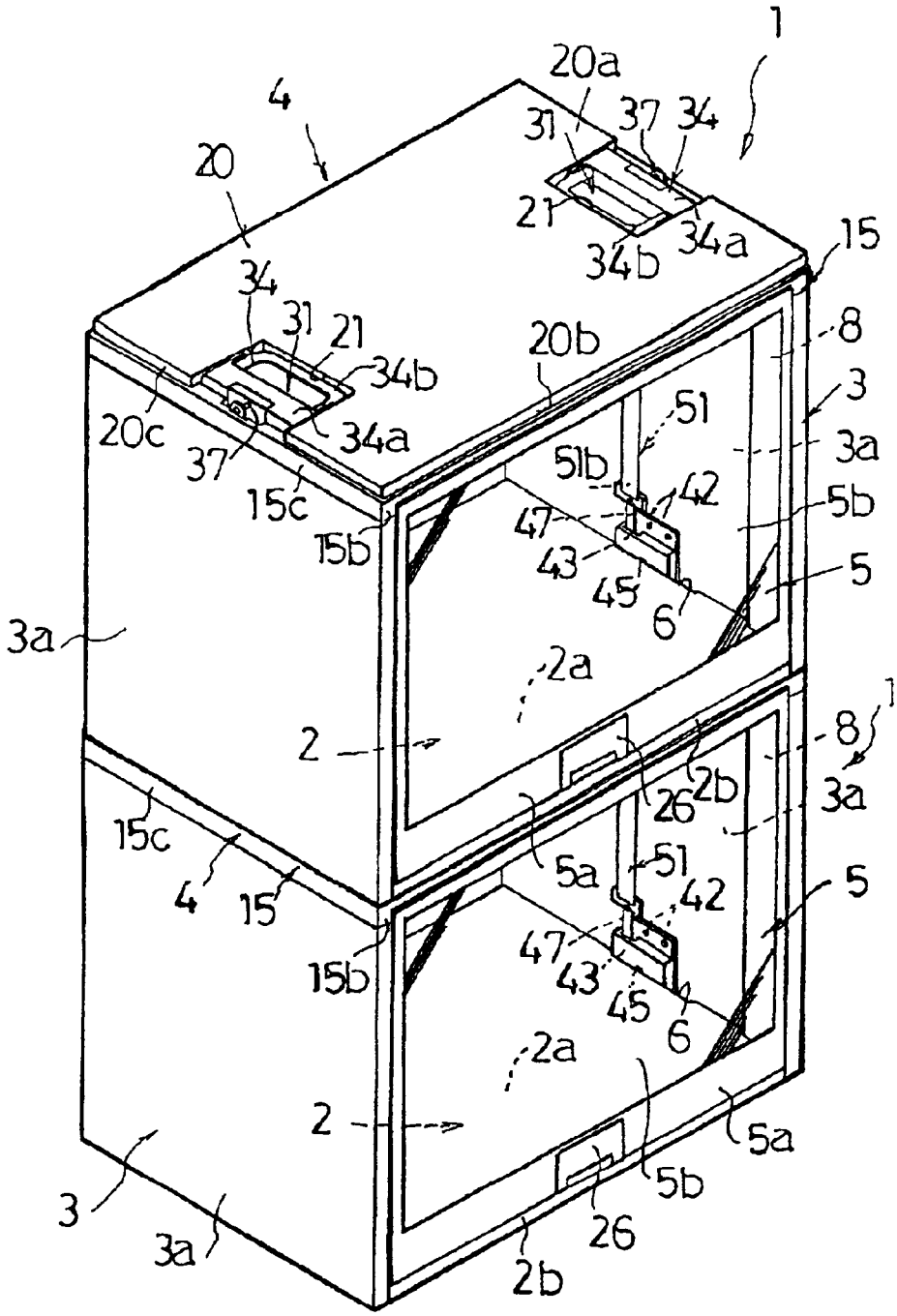
Figure 13:
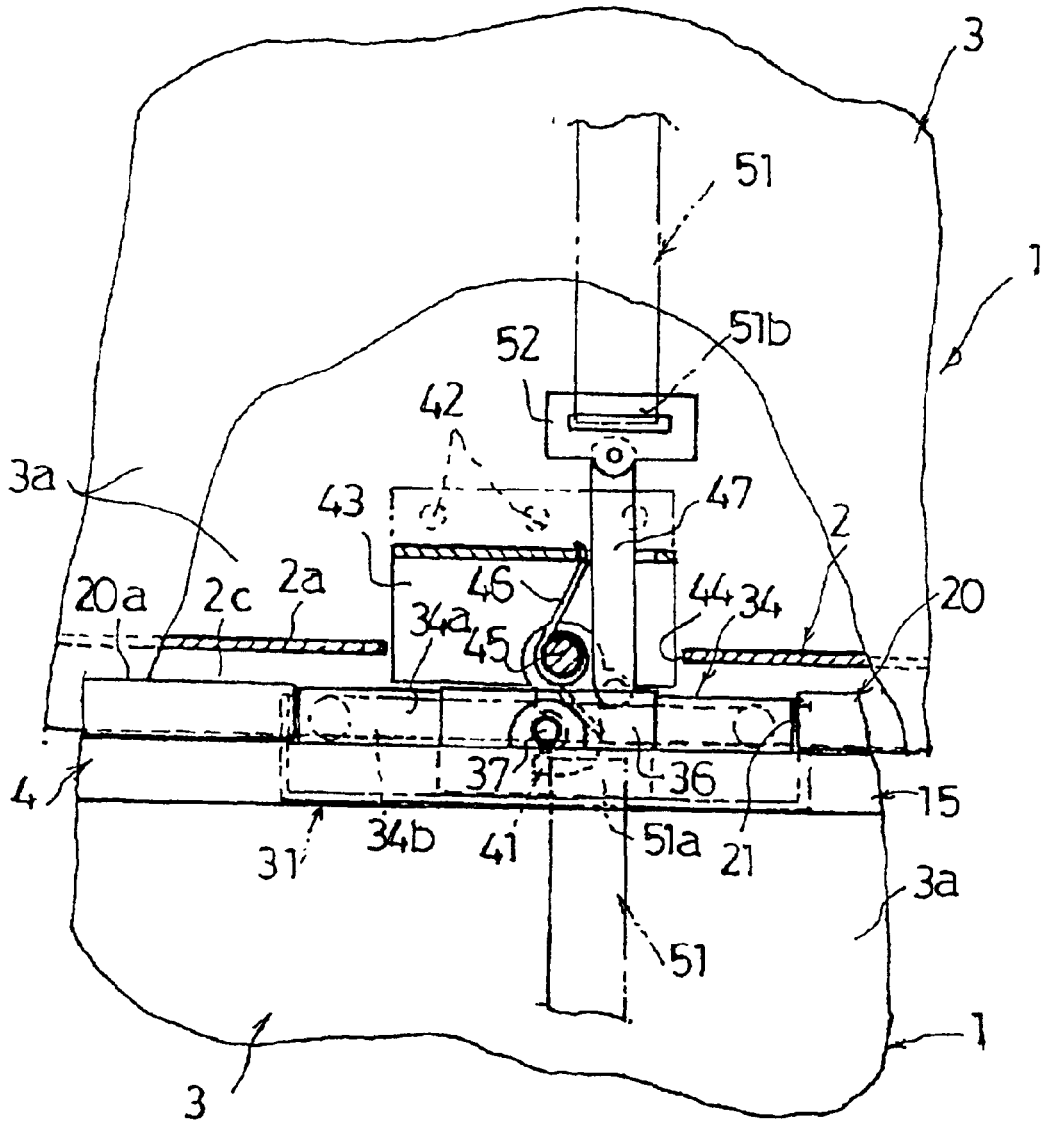
Figure 14:
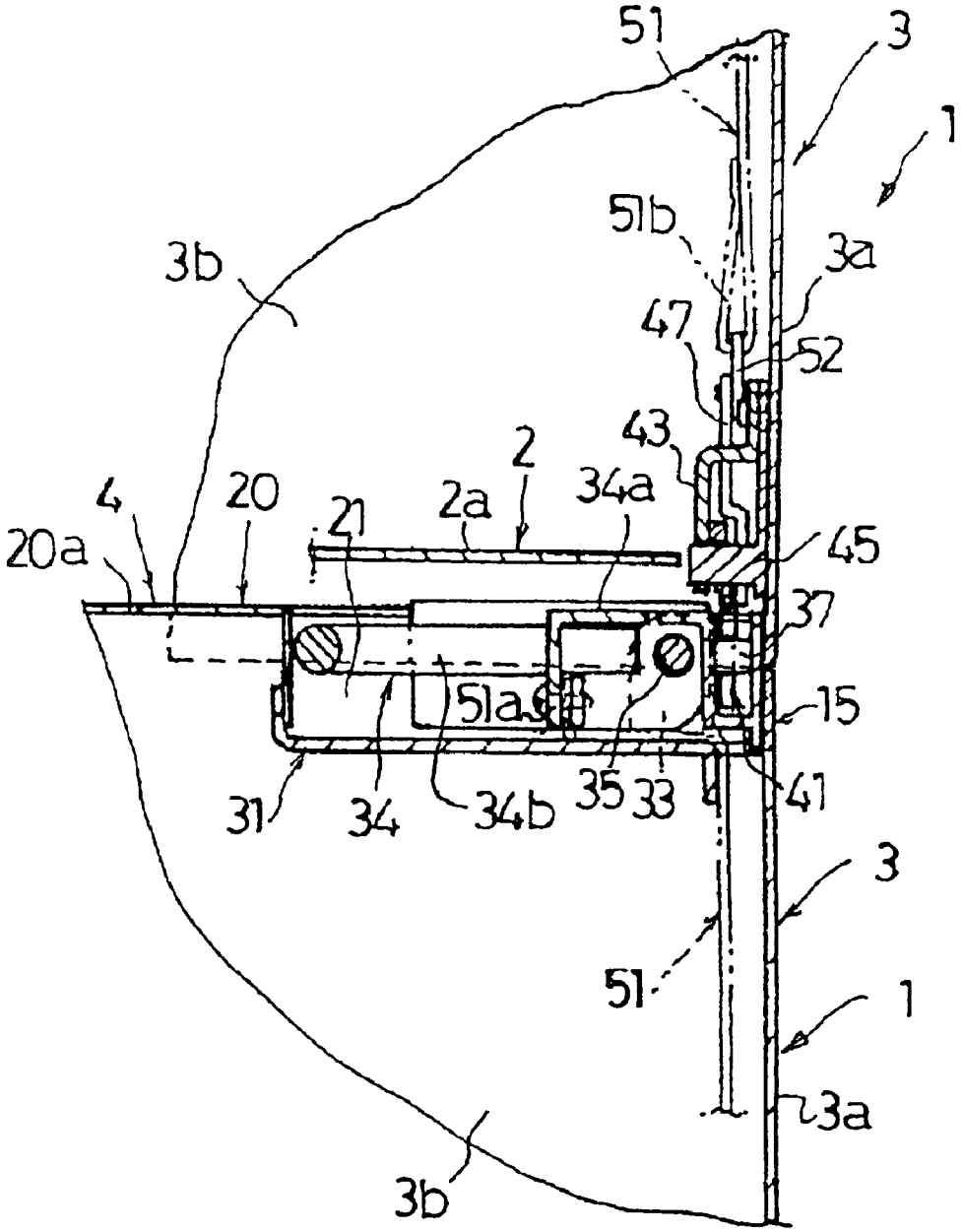

FIG. 12 illustrates the explanation view showing an example of the way in which the plurality of the storage compartments 1 and 1 is piled up in the vertical direction. In this case, in case that the handle 34 is embedded into the concave portion 21, the engaging piece 41 is engaged with the engaging stick 37 of the lower storage compartment 1 (see FIGS. 13 and 14).

Then, the handles 34 move to a standing-up state when the upper storage compartment 1 removes from the lower storage compartment 1 and move to somewhere else. If it does so, since the engaging piece 41 of the upper part storage compartment 1 separates automatically from engaging stick 37 of the lower part storage compartment 1, the upper storage compartment 1 can be carried as it is.

Although the engaging piece 41 of the first embodiment formed in the shape of a hook, it may change into "latch shape" by design.

Other embodiments of the present invention will now be described referring to FIGS. 15 to 17. Through the drawings of the embodiments, like components are denoted by like numerals as of the first embodiment and will not be further explained in great detail.

In a second embodiment, it is an object of the present invention to provide a connection structure of a storage compartment which it is made to wound a crack to the upper surface of the top board member 4 of a storage compartment located below when other storage compartment 1 piles up an the lower storage compartment 1. Therefore, the new requirement for composition is added to the principal part of the first embodiment.

Figure 15:
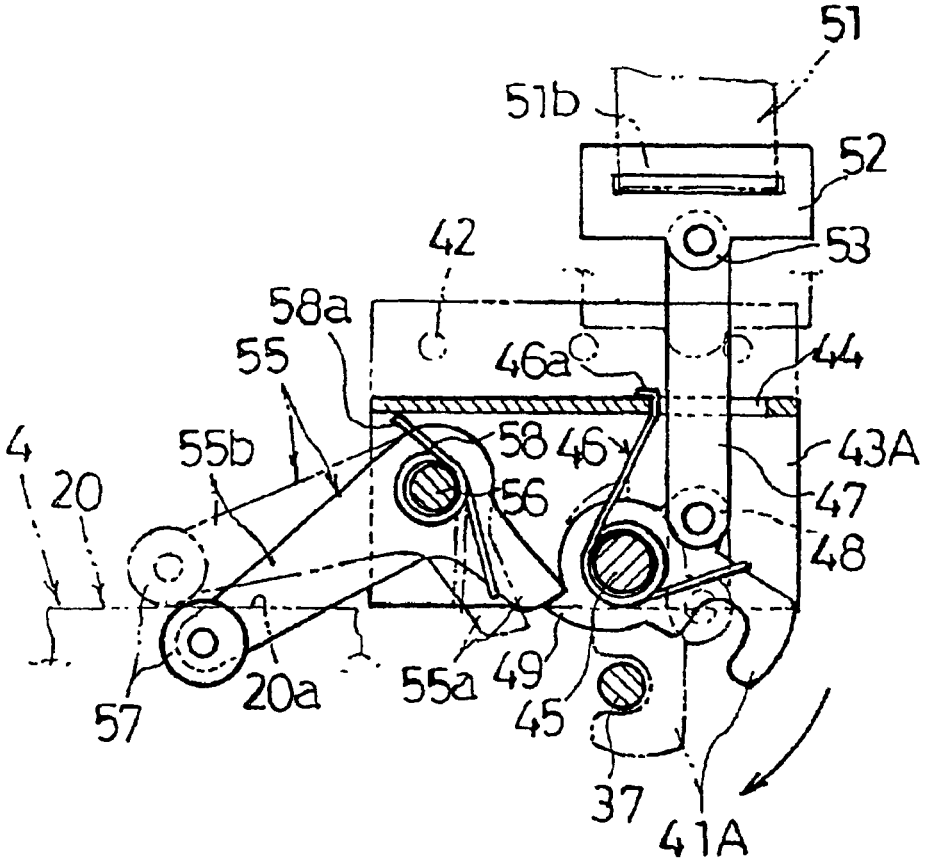
FIGS. 15 to 17 illustrate an explanation view showing a second embodiment of the present invention respectively.

Namely, as illustrated in FIG. 15, a second engaging portion 49 formed in the shape of a nail is projected from an opposite part faces to the projection 48 of an engaging piece 41A, a locking piece 55 engages with the 49 is supported pivotably by a support frame member 43A. The locking piece 55 is formed in a L-shaped lever and is supported pivotably by a second axle 56 located more nearly up than the axle 45.

The short lever part 55*a* may engages and removes with the second engaging portion 49 of the engaging piece 41A and the long lever part 55*b* including a roller 57 in a tip part thereof extends downward so as to counter with the engaging piece 41A and locate into the notch portion 6 of the base part 2*a* of the base board 2. The numeral 58 shows a lock spring which viases so as to make to engage with the engaging piece 41A of the locking piece 55 and is wound around the second axle 56. In addition, an end part 58*a* of the lock spring 58 presses contact with a plane surface portion of the support frame member 43A.

Figure 16:
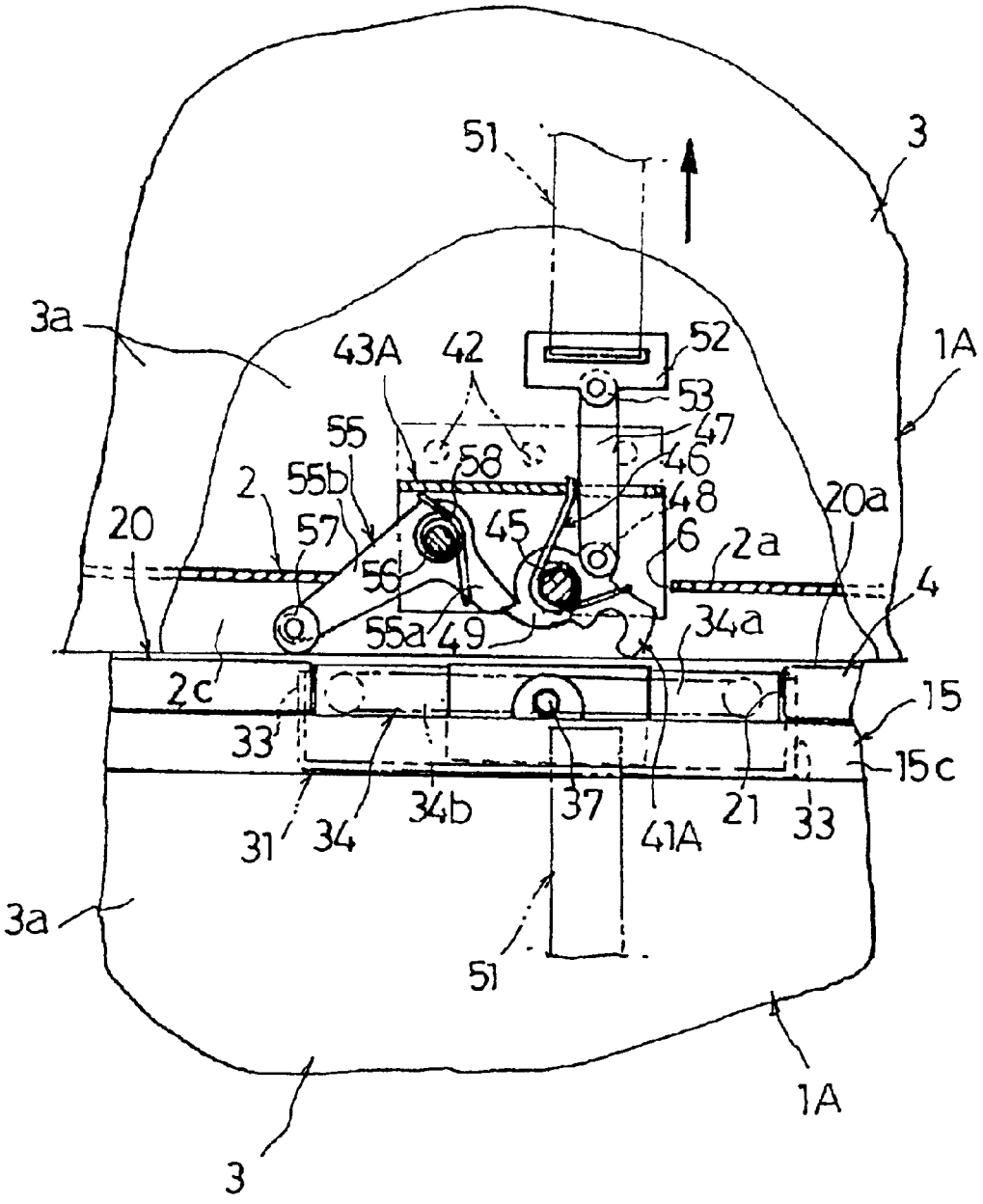
Figure 17:
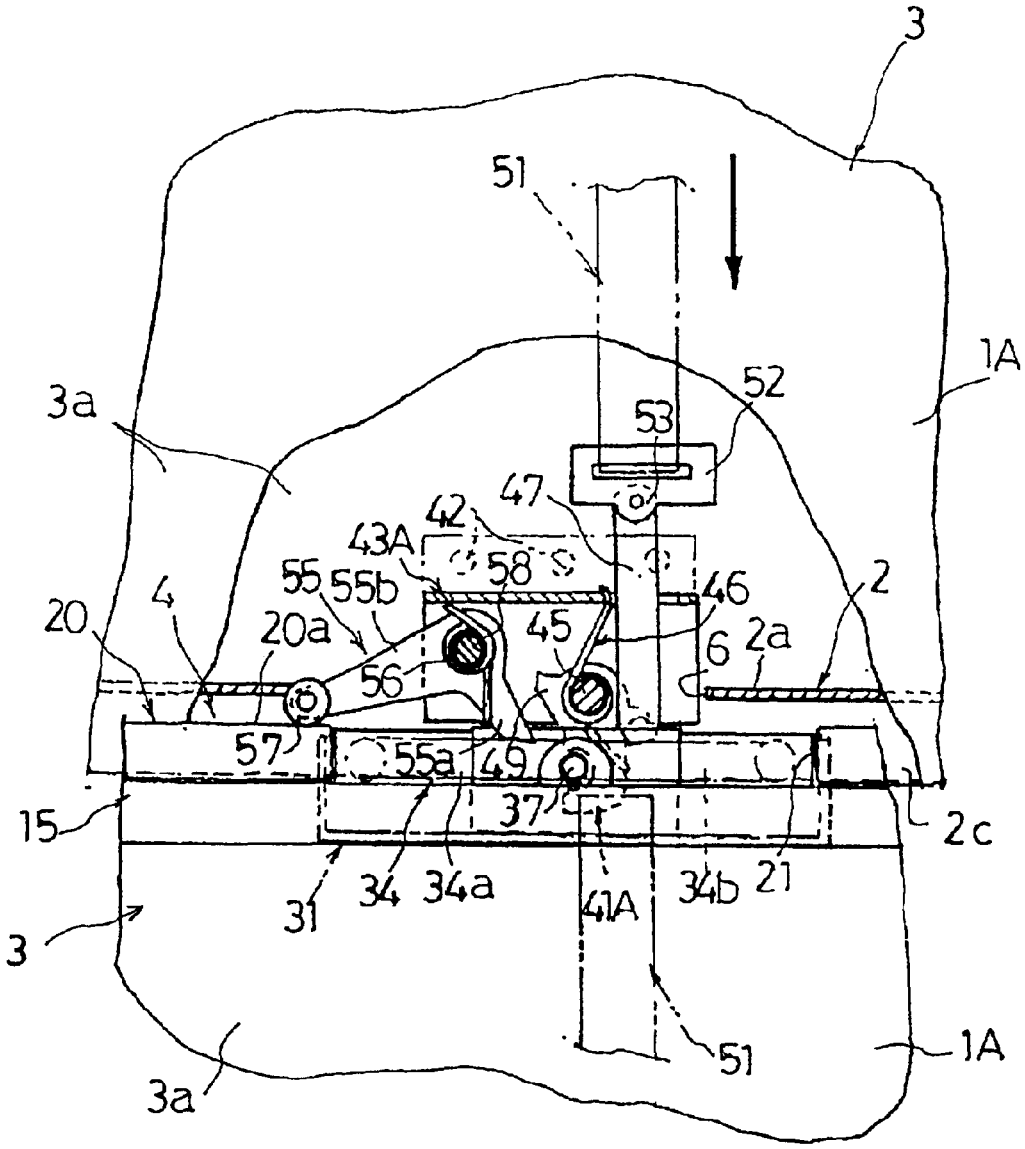

In the above-mentioned composition of the connection construction of the storage compartment, as illustrated in FIG. 16, when the engaging piece 41A is interlocked with standing-up state of the handle 34 and rotates in an unlocking direction, the short lever part 55*a* of the locking piece 55 having a sliding relation engages the second engaging potion of the engaging piece 41A. Therefore, the engaging piece 41A is engaged by the locking piece 55 and is in a state as it is.

Then, if other storage compartment 1A is now put the lower storage compartment 1A upon, the top board member 4 (outer board 20) of the lower storage compartment 1A enters into the baseboard 2 of the upper storage compartment 1A. That is, the upper storage compartment 1A is fitted in the lower storage compartment 1. Since the top board member 4 of the lower storage compartment 1A at this time pushes up the locking piece 55, it is in the state that can be rotated in an unlocking direction (clockwise rotation) of the second axle 56 at a fulcrum. Then, if the handle 34 is laid flat, the engaging piece 41A rotates in an engaging direction (clockwise rotation) according to the spring power of the spring 46 and is engaged with the engaging stick 37 of the lower storage compartment 1. Each of the storage compartments combines integrally (see FIG. 17).

As set forth above, the advantages of the invention are as follows:

(1) When the storage compartments 1 is piled up another storage compartment 1 to the vertical direction, the engaging piece engages with an engaging means of a storage compartment located below according to the spring power of a spring if the handle is laid flat at the horizontal state, on the other hand, if the handle is raised at the standing-up state, the engaging piece interlocks a motion of the handle and rotates towards an unlocking direction against the spring power of the spring. Therefore, only operating the both sides of the handle can automatically operate the engaging and removing of the upper and lower storage compartments.

(2) As discussed above, since the engaging piece is interlocked with a motion of a handle through a traction means, the upper storage compartment is carried as it is, and it removes only by one-action control (the handle is made to stand up) when the upper storage compartment is removed from the lower storage compartment and carried to other places.

(3) As discussed above, since the respectively same parts are used for parts including a handle, traction means and engaging piece, the number of parts to constitute can be reduced. Therefore, the cost can be reduced effectively.

(4) In claims 2 and 3, since the handle and engage means are set on the attachment base board, the number of assembly parts can be reduced.

(5) In case that a traction means is made by flexible material and it is interposed between the handle and engaging piece through a connection link, the engaging and removing can be operated smoothly.

(6) The top board member combines two boards having large one and small one, the large inner board consists of a top portion and the short side wall portion provided continuously at sides of the top portion and the outer board of the top board member of the storage compartment located below fits in the inner board, the upper and lower storage compartments are combined stably.

(7) The engaging piece is stopped connecting it to the locking piece if it rotates at a predetermined position. When the locking piece rotates against the spring power of the lock spring and removes from the engaging piece in case that the storage compartment piles upon the upper surface of the other storage compartment.

In this case, the top board member of the lower storage compartment is not wound. Especially if the roller is provided at the tip portion of the long lever portion of the locking piece, reliability is achieved.

(8) When the engaging piece and locking piece are supported pivotably through the axle to the support frame member fixed to the inner wall surface of the sidewall of the storage compartment respectively, the number of assembly parts can be reduced.

What is claimed is:

1. A connection structure of a storage compartment comprising:

a handle (34) movably mounted on a top board member (4) of the storage compartment between a stored position in which the handle is received within a storage part for the handle provided in the top board member and an upright position in which the handle extends above the storage part;

an engaging piece (41) movably mounted on a base board (2) of the storage compartment between a first position in which the engaging piece is contained within the storage compartment and a second position in which the engaging piece extends outside of the storage compartment, said engaging piece, when in said second position, being capable of interlocking with corresponding interlocking structure provided on a top board of a similarly constructed storage compartment when two similarly constructed storage compartments are stacked one above the other;

means for biasing said engaging piece toward said second position in which the engaging piece extends outside of the storage compartment;

tractive means (51) connecting the handle to said engaging piece, whereby movement of said handle from said stored position to said upright position causes the engaging piece to be moved from said second position in which the engaging piece extends outside of the storage compartment to said first position in which the engaging piece is contained within the storage compartment, wherein the handle is rotatably attached to the top board member through a horizontal axle (35) rotatably supported by axle hole parts (33, 33) of an attachment base board (31) which is mounted on the top board member.

2. The connection structure of the storage compartment according to claim 1, further comprising an engaging stick (37) provided fixedly at an outer end of the attachment base board (31) mounted on the top board member, said engaging stick (37) being capable of interlocking with an engaging piece provided on a bottom board of a similarly constructed storage compartment when two similarly constructed storage compartments are stacked one above the other.

3. A connection structure of a storage compartment comprising:

a handle (34) rotatably mounted on a top board member (4) of the storage compartment between a stored position in which the handle is received within a storage part for the handle provided in the top board member and an upright position in which the handle extends above the storage part;

an engaging piece (41) movably mounted on a base board (2) of the storage compartment between a first position in which the engaging piece is contained within the storage compartment and a second position in which the engaging piece extends outside of the storage compartment, said engaging piece, when in said second position, being capable of interlocking with corresponding interlocking structure provided on a top board of a similarly constructed storage compartment when two similarly constructed storage compartments are stacked one above the other;

means for biasing said engaging piece toward said second position in which the engaging piece extends outside of the storage compartment;

tractive means (51) connecting the handle to said engaging piece, whereby movement of said handle from said stored position to said upright position causes the engaging piece to be moved from said second position in which the engaging piece extends outside of the storage compartment to said first position in which the engaging piece is contained within the storage compartment.

4. The connection structure of the storage compartment according to claim 3, wherein the tractive means (51) is made of flexible material and attached to said engaging piece through a connection link (47) pivotably supported by the engaging piece (41).

5. The connection structure of the storage compartment according to claim 3, wherein the top board member (4) includes a large inner board (15) and a small outer board (20), the large inner board (15) further comprising a top portion **(15*a*) and short side wall portions (15*b*, 15*c*, 15*d*) provided downwardly and continuously at sides of the top portion (15*a*)**.

6. A connection structure of a storage compartment comprising:

a handle (34) movably mounted on a top board member (4) of the storage compartment between a stored position in which the handle is received within a storage part for the handle provided in the top board member and an upright position in which the handle extends above of the storage part;

an engaging piece (41A) movably mounted on a base board (2) of the storage compartment between a first position in which the engaging piece is contained within the storage compartment and a second position in which the engaging piece extends outside of the storage compartment, said engaging piece, when in said second position, being capable of interlocking with corresponding interlocking structure provided on a top board of a similarly constructed storage compartment when two similarly constructed storage compartments are stacked one above the other;

means (46) for biasing said engaging piece toward said second position in which the engaging piece extends outside of the storage compartment;

tractive means (51) connecting the handle to said engaging piece, whereby movement of said handle from said stored position to said upright position causes the engaging piece to be moved from said second position in which the engaging piece extends outside of the storage compartment to said first position in which the engaging piece is contained within the storage compartment;

and a locking piece (55) movably mounted on the base board (2) of the storage compartment adjacent the engaging piece, said locking piece being adapted to retain the engaging piece in said first position in which the engaging piece is contained within the storage compartment when the handle is in an upright position and to release the engaging piece so as to permit the engaging piece to be moved by said biasing means to said second position in which the engaging piece extends outside of the storage compartment when the storage compartment is piled upon the top board member of a storage compartment located below.

7. The connection structure of the storage compartment according to claim 6, wherein the engage piece (41A) and locking piece (55) are supported pivotably by a support frame member (43A) fixed to an inner wall surface of a sidewall of the storage compartment through axles (45, 56), respectively.

8. The connection structure of the storage compartment according to claim 6, further comprising a roller (57) provided at a tip portion of a long lever part (55*b*) of the locking piece (55).

* * * * *